US008783855B2

(12) United States Patent
Toya

(10) Patent No.: US 8,783,855 B2
(45) Date of Patent: Jul. 22, 2014

(54) IMAGE RECORDING DEVICE AND IMAGE RECORDING METHOD

(75) Inventor: Akihiro Toya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 135 days.

(21) Appl. No.: 13/210,710

(22) Filed: Aug. 16, 2011

(65) Prior Publication Data

US 2012/0062672 A1 Mar. 15, 2012

(30) Foreign Application Priority Data

Sep. 10, 2010 (JP) ..... 2010-203216

(51) Int. Cl.
*B41J 2/01* (2006.01)
*B41J 29/38* (2006.01)

(52) U.S. Cl.
USPC ..... 347/104; 347/16

(58) Field of Classification Search
None
See application file for complete search history.

(56) References Cited

U.S. PATENT DOCUMENTS

2004/0174421 A1* 9/2004 Tsuji ..... 347/104
2010/0225719 A1* 9/2010 Takatsuka ..... 347/102

FOREIGN PATENT DOCUMENTS

| | | | |
|---|---|---|---|
| JP | 08-197799 | A | 8/1996 |
| JP | 2004-018151 | A | 1/2004 |
| JP | 2007-160556 | A | 6/2007 |
| JP | 2007-276929 | A | 10/2007 |
| JP | 2007-313743 | A | 12/2007 |

* cited by examiner

*Primary Examiner* — Stephen Meier
*Assistant Examiner* — Alexander C Witkowski
(74) *Attorney, Agent, or Firm* — Global IP Counselors, LLP

(57) ABSTRACT

An image recording device includes a suction part that suctions a medium supported on a medium support part via suction holes, the medium being suctioned by at least two air-blowing parts, and a control part that stops one of the air-blowing parts during an action preceding the conveying action, whereby a first mode in which a first suction force is applied by the suction part on the medium is switched to a second mode in which a second suction force that is lower than the first suction force is applied by the suction part on the medium.

8 Claims, 6 Drawing Sheets

IMAGE RECORDING DEVICE AND IMAGE RECORDING METHOD

CROSS-REFERENCE TO RELATED APPLICATIONS

This application claims priority to Japanese Patent Application No. 2010-203216 filed on Sep. 10, 2010. The entire disclosure of Japanese Patent Application No. 2010-203216 is hereby incorporated herein by reference.

BACKGROUND

1. Technical Field

The present invention relates to an image recording device and an image recording method.

2. Related Art

In inkjet printers and the like, which are an example of image recording devices, a platen (medium support part) is provided for supporting a medium on which an image is printed so that the medium has a fixed alignment relative to a head for discharging ink (e.g. Patent Japanese Laid-Open Patent Publication No. 8-197799).

SUMMARY

For example, there are printers in which the platen is provided with suction holes and suction is applied to the medium through the suction holes so that the medium on the platen is held in a fixed position during printing. However, a strong suction force on the medium while the medium is conveyed is a hindrance to conveying. The suction force on the medium is then preferably reduced when the medium is conveyed. However, when time is allowed merely for reducing the suction force on the medium, the overall printing operating period will be longer.

The present invention was devised in view of such circumstances, and an object thereof is to shorten the overall recording operating period as much as possible.

An image recording device according to one aspect of the present invention includes a recording part, a conveying part, a medium support part, a suction part, and a control part. The recording part is configured and arranged to record an image on a medium. The conveying part is configured and arranged to convey the medium. The medium support part is configured and arranged to support the medium on a support surface provided with openings of suction holes. The suction part is configured and arranged to suction the medium supported on the medium support part via the suction holes, the medium being suctioned by at least two air-blowing parts. The control part is configured to repeatedly perform an action of conveying the medium using the conveying part and an action of recording the image on the medium using the recording part. The control part is configured to stop one of the two air-blowing parts during an action preceding the conveying action, whereby a first mode in which a first suction force is applied by the suction part on the medium is switched to a second mode in which a second suction force that is lower than the first suction force is applied by the suction part on the medium.

Other characteristics of the present invention will be made clear by the descriptions of the Specification and the accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
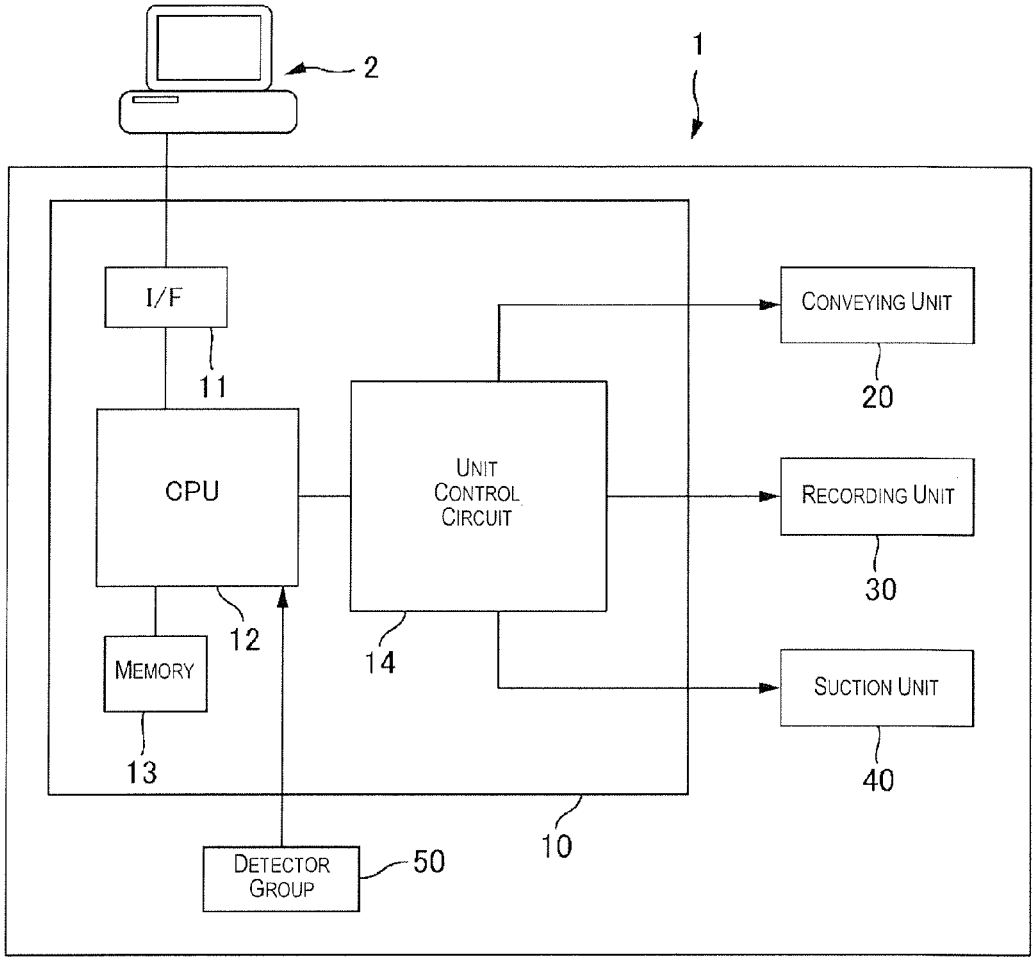
FIG. 1 is an overall configuration block diagram of a printer.

At least the following matters will be made clear from the descriptions of the Specification and the accompanying drawings.

An image recording device according to the embodiment includes a recording part, a conveying part, a medium support part, a suction part, and a control part. The recording part is configured and arranged to record an image on a medium. The conveying part is configured and arranged to convey the medium. The medium support part is configured and arranged to support the medium on a support surface provided with openings of suction holes. The suction part is configured and arranged to suction the medium supported on the medium support part via the suction holes, the medium being suctioned by at least two air-blowing parts. The control part is configured to repeatedly perform an action of conveying the medium using the conveying part and an action of recording the image on the medium using the recording part. The control part is configured to stop one of the two air-blowing parts during an action preceding the conveying action, whereby a first mode in which a first suction force is applied by the suction part on the medium is switched to a second mode in which a second suction force that is lower than the first suction force is applied by the suction part on the medium.

With such an image recording device, the overall recording operating period can be shortened.

In this image recording device, the action preceding the conveying action is preferably the recording action.

With such an image recording device, the overall recording operating period can be shortened.

In this image recording device, the control part is preferably configured to switch from the first mode to the second mode during the latter half of the recording action.

With such an image recording device, a high suction force can be exerted on the medium over a long period of time during the recording action. As a result, loss of image quality can be suppressed.

In this image recording device, the control part is preferably configured to stop the one of the air-blowing parts and to set a rotating speed of the other one of the air-blowing parts to a rotating speed corresponding to the second suction force when switching from the first mode to the second mode.

With such an image recording device, control can be made easier, and a stable transition can be made from the first mode to the second mode.

In this image recording device, the control part is preferably configured to stop the air-blowing parts when switching from the first mode to the second mode, and to set the rotating speed of the other one of the air-blowing parts to a rotating speed corresponding to the second suction force after a predetermined period has elapsed.

With such an image recording device, the period for switching from the first mode to the second mode can be shortened.

In this image recording device, the one of the air-blowing parts preferably includes at least two air-blowing mechanisms aligned in series.

With such an image recording device, a higher suction force can be achieved in the first mode, and a lower suction force can be achieved in the second mode.

An image recording method according to the embodiment is a method for recording an image on a medium by an image recording device including: a recording part configured and arranged to record an image on a medium; a conveying part configured and arranged to convey the medium; a medium support part configured and arranged to support the medium on a support surface provided with openings of suction holes; a suction part configured and arranged to suction the medium supported on the medium support part via the suction holes, the medium being suctioned by at least two air-blowing parts; and a control part configured to repeatedly perform an action of conveying the medium using the conveying part and an action of recording the image on the medium using the recording part. The image recording method comprising: stopping by using the control part one of the two air-blowing parts during an action preceding the conveying action, whereby a first mode in which a first suction force is applied by the suction part on the medium is switched to a second mode in which a second suction force that is lower than the first suction force is applied by the suction part on the medium.

With such an image recording device, the overall recording operating period can be shortened.

Printer

An embodiment is described hereinbelow using an inkjet printer (hereinbelow, a printer) as an example of the "image recording device."

Figure 2:
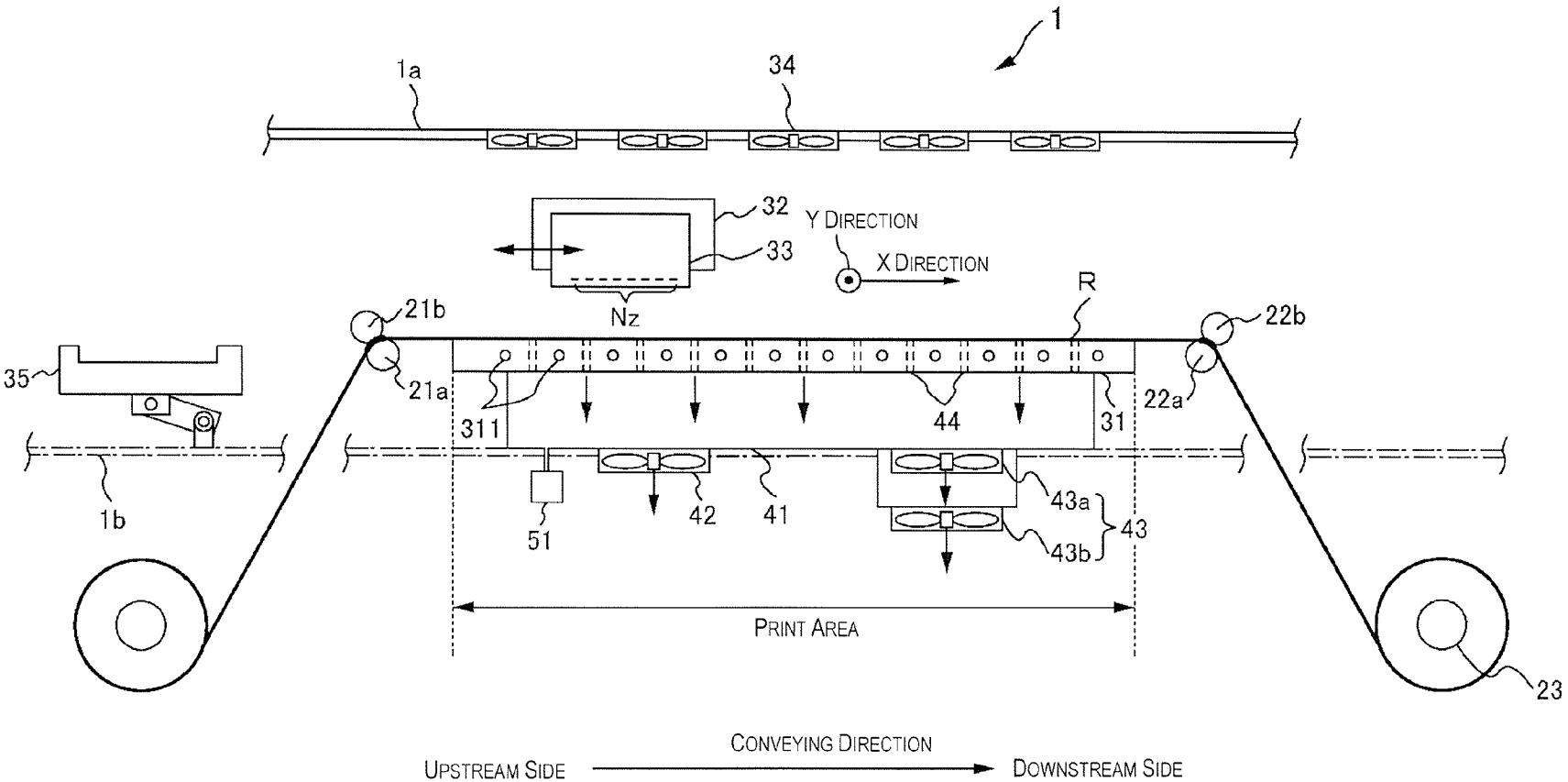
FIG. 2 is a cross-sectional view showing an outline of the printer.

FIG. 1 is an overall configuration block diagram of a printer 1. FIG. 2 is a cross-sectional view showing an outline of the printer 1. The printer 1 of the present embodiment prints images on roll paper R (continuous paper) as a medium. The medium is not limited to paper, and may be film or cloth, for example. The printer 1 of the present embodiment is communicably connected with a computer 2, and the computer 2 creates print data for causing the printer 1 to print images. The functions of the computer 2 may also be installed within the printer 1.

A controller 10 is a control unit for controlling the printer 1. An interface 11 is for conducting the transmission of data between the computer 2 and the printer 1. A CPU 12 is a computing and processing device for controlling the entire printer 1. A memory 13 is for ensuring areas for storing the programs of the CPU 12, operational areas, and the like. The CPU 12 controls the units in accordance with a unit control circuit 14. A detector group 50 observes conditions within the printer 1 and a controller 10 controls the units on the basis of the detection results.

A conveying unit 20 (equivalent to the conveying part) is for conveying the roll paper R from an upstream side to a downstream side of a conveying direction along a preset conveying route, and is also for conveying part of the roll paper R to a print area (equivalent to the image recording area). The conveying unit 20 has supply rollers 21*a*, 21*b*, ejection rollers 22*a*, 22*b*, a winding roller 23, and other components. The supply rollers 21*a*, 21*b* and the ejection rollers 22*a*, 22*b* are each composed of rollers constituting pairs, wherein one roller is a drive roller rotated by a motor (not shown), while the other roller is a driven roller rotated in conjunction with the drive roller. When image printing on the roll paper R positioned in the print area ends, the region of the roll paper R on which the image is printed is ejected from the print area by the supply rollers 21*a*, 21*b*, the ejection rollers 22*a*, 22*b*, and other components, then wound up into a roll by the winding roller 23, and a region of the roll paper R on which no image has yet been printed is supplied to the print area.

A recording unit 30 (equivalent to the recording part) is for printing (recording) images on the roll paper R positioned in the print area. The roll paper R positioned in the print area is supported from the back surface opposite the printed surface by the top surface of a platen 31. The recording unit 30 has a carriage 32, a head 33, and other components. The carriage 32 moves the head 33 in an X direction (the conveying direction of the roll paper R) and a Y direction (the width direction of the roll paper R) while being guided on a guide shaft (not shown). The head 33 is for discharging ink onto the roll paper R, and the underside of the head 33 is provided with a plurality of nozzles Nz which are ink discharge parts. The system whereby ink is discharged from the nozzles may be a piezo system which applies voltage to drive elements (piezo elements) and expands and contracts pressure chambers to discharge ink, or a thermal system which uses heat-generating elements to form bubbles in the nozzles and discharges ink by the bubbles.

A plurality of heaters 311 (e.g. nichrome wires) are set up inside the platen 31. Supplying electricity to the heaters 311 causes the temperature of the platen 31 to rise, and the temperature of the roll paper Ron the platen 31 (i.e. the roll paper R positioned in the print area) also rises. As a result, drying of the ink deposited on the roll paper R on the platen 31 can be promoted, and blurring of the ink in the print area can be suppressed. The heaters 311 are set up through the entire platen 31 so that heat is evenly conducted to the roll paper R on the platen 31. Thus, the platen 31 supports the roll paper R positioned in the print area on the top surface (the support surface), and heats the roll paper R positioned in the print area as well.

In the ceiling 1*a* of the casing of the printer 1, a plurality of ceiling fans 34 are provided so as to face the platen 31. Air is blown from the ceiling fans 34 onto the roll paper R on the platen 31, whereby drying of the ink deposited on the roll paper R on the platen 31 can be promoted.

The carriage 32 and the head 33 are capable of withdrawing to a home position which is upstream of the print area in the conveying direction. A cap mechanism 35 or the like is provided to the home position. While printing has stopped, evaporation of ink from the nozzles can be suppressed by tightly sealing the nozzle surface of the head 33 by the cap mechanism 35.

A flat plate-shaped base stand 1*b* is provided inside the casing of the printer 1, and the casing interior is sectioned into two spaces. Images are printed on the roll paper R in the space above the base stand 1*b*. Consequently, the head 33 and the carriage 32 are disposed in the space above the base stand 1*b*, and the platen 31, the negative pressure chamber 41, the cap mechanism 35, and other components are placed on top of the base stand 1*b*.

A suction unit 40 is for holding the roll paper R on the platen 31 to the support surface of the platen 31 by suction, and the suction unit 40 has a negative pressure chamber 41, a first fan mechanism 42, a second fan mechanism 43, suction holes 44, and other components. The negative pressure chamber 41 is connected to the bottom surface of the platen 31, and the first fan mechanism 42 and second fan mechanism 43 are attached to the bottom surface of the negative pressure chamber 41 and aligned in the conveying direction. The second fan mechanism 43 is composed of two fans 43*a*, 43*b*, wherein to the underside of one fan 43*a* (the discharge opening side) is attached the other fan 43*b*. The suction holes 44, which are holes extending in the vertical direction, are formed through the platen 31, and the openings on one side of the suction holes 44 are formed in the support surface of the platen 31, while the openings on the other side of the suction holes 44 are formed in the bottom surface of the platen 31 (the surface where the platen 31 and the negative pressure chamber 41 connect). Specifically, the negative pressure chamber 41 is communicated with the exterior (the top part of the platen 31) via the suction holes 44. The heated platen 31 (equivalent to the medium support part) supports the roll paper R on a support surface provided with the openings of the suction holes 44.

The first fan mechanism 42 and the second fan mechanism 43 blow air in the negative pressure chamber 41 out to the exterior (specifically, suction out the air in the negative pressure chamber 41), creating a state of negative pressure inside the negative pressure chamber 41. At this time, the outside air above the support surface of the platen 31 is suctioned into the negative pressure chamber 41 via the suction holes 44, and the roll paper R on the platen 31 is held on the support surface of the platen 31 by suction. Specifically, the suction unit 40 (equivalent to the suction part) uses the two fan mechanisms 42, 43 to suction the roll paper R supported on the platen 31 via the suction holes 44.

During printing, due to the roll paper R on the platen 31 being held by suction on the support surface of the platen 31, the roll paper R is held in a predetermined position in the support surface of the platen 31, and ink droplets can be deposited in the proper positions. The roll paper R can also be kept flat even if the roll paper R swells due to the moisture in the ink droplets.

With such a printer 1, the controller 10 causes the head 33 to print (equivalent to the recording action) a two-dimensional image on the roll paper R positioned in the print area while moving the head 33 and the carriage 32 in the X direction and Y direction. The controller 10 then causes the conveying unit 20 to eject the region of the roll paper R that has the printed image out of the print area, and to supply the region of the roll paper R not yet having an image printed to the print area (equivalent to the conveying action). In other words, by repeatedly performing the image printing action and the roll paper R conveying action, the controller 10 (equivalent to the control part) causes numerous images to be printed along the direction in which the roll paper R continues.

Maintenance Action

The moisture in the ink readily evaporates from the menisci of the nozzles (the free surfaces of the ink exposed to the exterior), and the viscosity of the ink increases due to this evaporation. When the ink increases in viscosity, the prescribed amount of ink is not discharged when the ink should be discharged from the nozzles, and discharging becomes less efficient. Atmospheric air gets mixed in through the menisci of the nozzles, and foreign substances adhere to the nozzles, causing discharge to be less efficient. When nozzle discharge becomes less efficient, the printed image quality suffers.

In view of this, with the printer 1 of the present embodiment, a maintenance action is performed periodically. The term "maintenance action" refers to a "discharge problem inspection" for detecting whether or not there are nozzles having discharge problems (problematic nozzles), or a "cleaning action" for ensuring that ink is not discharged as normal from the problematic nozzles. In the maintenance action, for example, one option is that the cleaning action be performed only when problematic nozzles have been detected after the discharge problem inspection has been performed, and another option is that the cleaning action and the discharge problem inspection be repeatedly performed until problematic nozzles are no longer detected.

Discharge Problem Inspection

A discharge problem inspection unit (not shown) of the present embodiment has detection electrodes of high electric potential, an ink recovery part, and other components, and the detection electrodes are placed inside the ink recovery part. The discharge problem inspection unit is placed on the base stand 1*b* of the printer 1 when in the home position, similar to the cap mechanism 35 of FIG. 2. The nozzle surface of the head 33 (the nozzle plate; a plate-shaped member having electrical conductivity) is connected to ground, having a lower electric potential (ground potential) than the detection electrodes, and the solvent of the ink is a liquid (e.g. water) having electrical conductivity. Consequently, the ink discharged from the nozzles has ground potential.

During the discharge problem inspection, first, the head 33 is withdrawn to the home position. The head 33 (the nozzle plate) and the detection electrodes then face each other across a predetermined distance, and ink is discharged (continuously) from the nozzles being inspected. Based on electrical variation (electric potential variation) detection electrodes as caused by ink discharge, a determination is made of whether or not ink droplets have been discharged properly from the nozzles being detected. For example, electrical variation occurring in the detection electrodes is acquired as a voltage signal, and if the maximum amplitude of the voltage signal is greater than a threshold, it is determined that ink has been discharged properly from the nozzles, whereas if the maximum amplitude of the voltage signal is equal to or less than a threshold, it is determined that ink has not been discharged properly from the nozzles. Since the ink discharged from the nozzles to the detection electrodes is recovered by the ink recovery part, the interior of the printer 1 can be prevented from getting dirty. The discharge problem inspection method is not limited to this example, and other methods may be used.

Cleaning Action

In the present embodiment, flushing, pump suction, wiping, or the like is performed as the cleaning action. As during the discharge problem inspection, the head 33 is withdrawn to the home position during the cleaning action as well.

The term "flushing" refers to the action of forcefully discharging ink from the nozzles while the head 33 and the ink recovery part (not shown) are facing each other, and causing the more viscous ink and foreign substances adhering to the nozzle surface to be discharged along with the ink.

The term "pump suction" refers to an action of firmly pressing the nozzle surface of the head 33 and the ink recovery part together and applying pump suction via a tube connected to the bottom surface of the ink recovery part (not shown), thereby suctioning out the ink in the head 33 along with the more viscous ink and foreign substances.

The term "wiping" refers to an action of scraping the nozzle surface with a rubber wiper or the like to remove foreign substances and the like.

High Suction Mode and Low Suction Mode

Figure 3A:
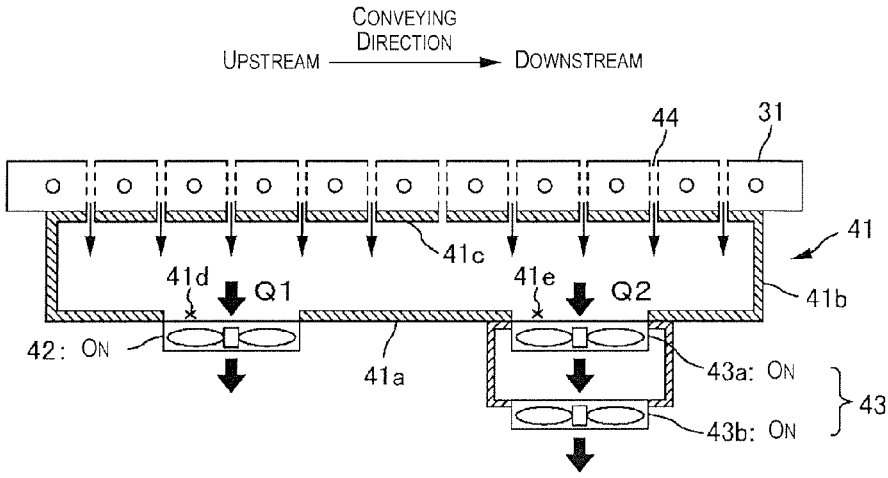
FIG. 3A is a drawing describing the high suction mode.
Figure 3B:
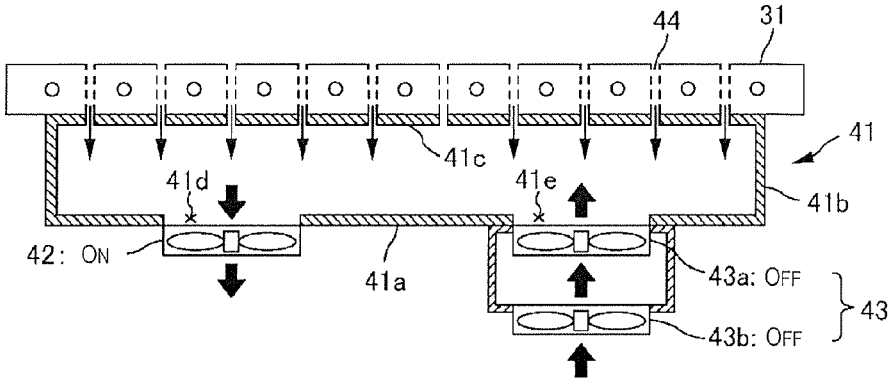
FIG. 3B is a drawing describing the low suction mode.

FIG. 3A is a drawing for describing high suction mode, and FIG. 3B is a drawing for describing the low suction mode. The printer 1 of the present embodiment, as previously described, has a suction unit 40 for suctioning the roll paper R supported on the platen 31 via the suction holes 44, and the suction unit 40 includes a negative pressure chamber 41 communicated with the suction holes 44, and a first fan mechanism 42 and second fan mechanism 43 for blowing out the air inside the negative pressure chamber 41 and creating negative pressure inside the negative pressure chamber 41. The top surface 41*c* of the negative pressure chamber 41 is provided with numerous holes, and the holes provided in the top surface 41*c* of the negative pressure chamber 41 are communicated with the suction holes 44 provided to the platen 31. The "first fan mechanism 42 and second fan mechanism 43" herein are equivalent to the "two air-blowing parts," and a "(axial flow) fan" is given as an example of an "air-blowing mechanism."

During the action of printing an image on the roll paper R, the suction-holding force of the roll paper R on the support surface of the platen 31 should be as strong as possible in order to hold the roll paper R on the platen 31 in a predetermined position and to keep the roll paper R flat even if the roll paper R swells due to the moisture in the ink. During the printing action, holding the roll paper R firmly by suction to the support surface of the platen 31 to keep the roll paper R in a flat state causes the heat of the platen 31 (the heaters 311) to be transferred to the roll paper R on the platen 31, drying of the ink can be promoted, and blurring of the image can be prevented. Ink droplets can be deposited in the proper positions on the roll paper R, and the roll paper R and head 33 can be prevented from coming in contact with each other. Specifically, during the printing action, loss of quality in the printed image can be suppressed by keeping the roll paper R on the platen 31 in a flat state in the predetermined position.

While the roll paper R is being conveyed, the suction-holding force of the roll paper R on the support surface of the platen 31 should be as low as possible without releasing the roll paper R, so as not to create a large amount of resistance against conveying.

In other words, during the conveying action, the suction force of the suction unit 40 on the roll paper R on the platen 31 should be lower than during the printing action. Thus, the appropriate suction force on the roll paper R on the platen 31 differs according to the process action.

In view of this, in the printer 1 of the present embodiment, the controller 10 can switch between a "high suction mode (equivalent to the first mode)" in which the suction force of the suction unit 40 on the roll paper R is set to a high suction force (equivalent to the first suction force), and a "low suction mode (equivalent to the second mode)" in which the suction force of the suction unit 40 on the roll paper R is set to a suction force (equivalent to the second suction force) which is lower than the suction force in the high suction mode.

The controller 10 sets the high suction mode during the printing action and sets the low suction mode while the roll paper R is being conveyed. Thereby, the roll paper R on the platen 31 can be kept flat in the predetermined position during the printing action, and loss of quality in the printed image can be prevented. During the conveying action of the roll paper R, the suction-holding force of the roll paper Ron the support surface of the platen 31 can be lessened, and the roll paper R can be conveyed smoothly. Conversely, the drive force of the conveying unit 20 (e.g. the tensile force of the ejection rollers 22*a*, 22*b*) can be reduced by setting to the low suction mode while the roll paper R is being conveyed.

To vary the suction force on the roll paper R on the platen 31, the negative pressure inside the negative pressure chamber 41 is preferably varied. The suction force on the roll paper R on the platen 31 can be increased by increasing the negative pressure in the negative pressure chamber 41 (by lowering the pressure), and the suction force on the roll paper R on the platen 31 can be reduced by reducing the negative pressure in the negative pressure chamber 41 (by raising the pressure). Specifically, the printer 1 of the present embodiment can be considered a printer that can switch between a mode in which the negative pressure in the negative pressure chamber 41 is set to a high negative pressure and a mode in which the negative pressure in the negative pressure chamber 41 is set to a low negative pressure.

In the present embodiment, instead of switching from the high suction mode to the low suction mode after the printing action has ended, a switch is made from the high suction mode to the low suction mode during the printing action in order to shorten the period for the overall printing operation (to be described in detail hereinafter). In this case, when switching from the high suction mode to the low suction mode takes place over a long period, the period in which the high suction mode is not in effect during the printing action will be longer.

Consequently, an object in the present embodiment is that the period for switching from the high suction mode to the low suction mode (i.e. the period required to reduce the suction force on the roll paper R) be shortened as much as possible.

In view of this, in the printer 1 of the present embodiment, the first fan mechanism 42 and the second fan mechanism 43 are attached in different positions on the bottom surface 41*a* of the negative pressure chamber 41 (the two fan mechanisms 42, 43 are attached in parallel without the axes of the two fan mechanisms 42, 43 being positioned along the same axis). The controller 10 stops one fan mechanism 43 (equivalent to one air-blowing part) of the two fan mechanisms 42, 43 (equivalent to the two air-blowing parts) during the low suction mode.

Specifically, during the high suction mode, the first fan mechanism 42 and the second fan mechanism 43 are both turned on as shown in FIG. 3A. In this case, the air in the negative pressure chamber 41 is blown out to the exterior by the two fan mechanisms 42, 43. During the low suction mode, the first fan mechanism 42 is turned on and the second fan mechanism 43 is turned off (stopped) as shown in FIG. 3B. In this case, the air in the negative pressure chamber 41 is blown out to the exterior by the first fan mechanism 42 while the interior of the negative pressure chamber 41 is opened to the atmosphere by the second fan mechanism 43. Therefore, outside air is drawn into the negative pressure chamber 41 through the second fan mechanism 43. To be more specific, outside air is led through the suction port of the second fan mechanism 43 and the opening 41*e* of the negative pressure chamber 41 and drawn into the negative pressure chamber 41. As a result, the negative pressure in the negative pressure chamber 41 immediately decreases (the pressure rises), and the mode can be quickly switched from the high suction mode to the low suction mode.

In other words, according to the printer 1 of the present embodiment, since the second fan mechanism 43 is stopped during the low suction mode and the second fan mechanism 43 (more precisely, the opening 41*e* of the negative pressure chamber 41 communication with the suction port of the second fan mechanism 43) is used as an "air hole," the period for switching from the high suction mode to the low suction mode can be shortened.

As a result, the period for the high suction mode can be lengthened during the printing action.

By using the second fan mechanism 43 as an air hole during the low suction mode, which second fan mechanism 43 is used to create high negative pressure during the high suction mode, there is no need to provide a separate air hole (e.g. an automatic opening and closing window), and the configuration of the device can be simplified.

Since one fan mechanism 43 of the two fan mechanisms 42, 43 is stopped during the low suction mode, loud noise and vibration can be reduced and power consumption can be minimized in comparison with the high suction mode.

In the printer 1 of the present embodiment, the two fan mechanisms 42, 43 are attached in parallel with the negative pressure chamber 41 in order to stop one fan mechanism 43 of the two fan mechanisms 42, 43 and use it as an air hole during the low suction mode. When the two fans are attached in parallel, more air is blown but the static pressure mostly does not change.

In view of this, the design intends for the quantity of air ($m^3$/h) passing through the opening of the negative pressure chamber 41 communicated with the suction port of one fan mechanisms of the two fan mechanisms attached in parallel to be greater than the quantity of air ($m^3$/h) passing through the opening of the negative pressure chamber 41 that is communicated with the suction port of the other fan mechanism. In other words, the negative pressure created in the negative pressure chamber 41 by one of the two fan mechanisms attached in parallel is higher than the negative pressure created in the negative pressure chamber 41 by the other fan mechanism.

Therefore, in the printer 1 of the present embodiment, the first fan mechanism 42 configured from one fan and the second fan mechanism 43 composed of two fans attached in series (attached to that the axes of the two fans are positioned coaxially) are attached in parallel. By attaching and operating two fans in series, the static pressure can be improved more so than operating one fan having the same characteristics. Specifically, when two fans (the second fan mechanism 43) attached in series blow out the air in the negative pressure chamber 41, higher negative pressure can be created in the negative pressure chamber 41 than when one fan (the first fan mechanism 42) blows out the air in the negative pressure chamber 41.

In other words, in the printer 1 of the present embodiment, due to the first fan mechanism 42 and the second fan mechanism 43 whose static pressure characteristics are higher than the first fan mechanism 42 being attached in parallel, the quantity of air Q2 passing through the opening 41*e* of the negative pressure chamber 41 communicated with the suction port of the second fan mechanism 43 is greater than the quantity of air Q1 passing through the opening 41*d* of the negative pressure chamber 41 communicated with the suction port of the first fan mechanism 42.

Thereby, the negative pressure in the negative pressure chamber 41 can be further increased in the high suction mode by the second fan mechanism 43 creating a greater quantity of air Q2 passing through the opening 41*e* of the negative pressure chamber 41 (i.e. the second fan mechanism 43 having greater maximum static pressure characteristics), and the negative pressure in the negative pressure chamber 41 can be further reduced in the low suction mode by the first fan mechanism 42 creating a lesser quantity of air Q1 passing through the opening 41*d* of the negative pressure chamber 41 (i.e. the first fan mechanism 42 having lesser maximum static pressure characteristics). In other words, the range of negative pressure created in the negative pressure chamber 41 can be expanded, the desired high negative pressure can be achieved in the negative pressure chamber 41 during the high suction mode (e.g. during the printing action), and the desired low negative pressure can be achieved in the negative pressure chamber 41 during the low suction mode (e.g. during the conveying action).

The quantities of air passing through the openings of the negative pressure chamber 41 communicated with the respective suction ports of the fans can be made to differ by attaching one fan having comparatively low static pressure characteristics in parallel with one fan having comparatively high static pressure characteristics. However, a fan of high static pressure characteristics which achieves the desired high negative pressure in the negative pressure chamber 41 during the high suction mode will be a large fan and will have a high cost.

The quantities of air passing through the openings of the negative pressure chamber 41 communicated with the respective suction ports of the fans can also be made to differ by using different rotating speeds of the fans, even when two fans having the same static pressure characteristics are attached in parallel. However, there is a limit on the difference that can be achieved between the quantities of air passing through the openings of the negative pressure chamber 41 merely by adjusting the rotating speeds of the fans. The negative pressure difference in the negative pressure chamber 41 between the high suction mode and the low suction mode will then be small, and it will be difficult to achieve the desired negative pressure in the negative pressure chamber 41.

Consequently, it is preferable that one fan mechanism (the second fan mechanism 43) of the two fan mechanisms 42, 43 be configured with two fans attached in series, as is the case in the present embodiment. The device can thereby be reduced in size and cost, and different quantities of air can be made to pass through the openings of the negative pressure chamber 41 communicated with the suction ports of the respective fans attached in parallel. As a result, the range of negative pressure created in the negative pressure chamber 41 can be broadened, the suction force on the roll paper R can be a higher suction force in the high suction mode, and the suction force can be a lower suction force in the low suction mode. The number of fans attached in series in the second fan mechanism 43 may be two or more.

Even if the first fan mechanism 42 having low maximum static pressure characteristics is stopped during the low suction mode, since the first fan mechanism 42 is used as an air hole, the negative pressure in the negative pressure chamber 41 during the low suction mode can still be lower than during the high suction mode in which the two fan mechanisms 42, 43 are turned on. By stopping the second fan mechanism 43 composed of the two fans 43*a*, 43*b* attached in series (i.e. the second fan mechanism 43 having high maximum static pressure characteristics) during the low suction mode as in the present embodiment, the negative pressure in the negative pressure chamber 41 during the low suction mode can be further reduced. As a result, the suction-holding force of the roll paper R on the support surface of the platen 31 can be lessened, conveying can be performed smoothly, and the drive force of the conveying unit 20 can be reduced, for example.

The pressure (negative pressure) inside the negative pressure chamber 41 during the high suction mode and the low suction mode is preferably set according to the drive force of the conveying unit 20, the type of roll paper R, and other factors; for example, the pressure in the negative pressure chamber 41 in the high suction mode is preferably set at 805 Pa less than atmospheric pressure, and the pressure in the negative pressure chamber 41 in the low suction mode is preferably set at 140 Pa less than atmospheric pressure. The negative pressure in the negative pressure chamber 41 can also be adjusted to the desired negative pressure by adjusting the rotating speeds of the fan mechanisms 42, 43. A pressure sensor 51 for detecting the pressure of the air inside the negative pressure chamber 41 is provided to the negative pressure chamber 41, and the controller 10 may confirm whether or not the pressure in the negative pressure chamber 41 is the desired pressure (negative pressure), for example.

Figure 4A:
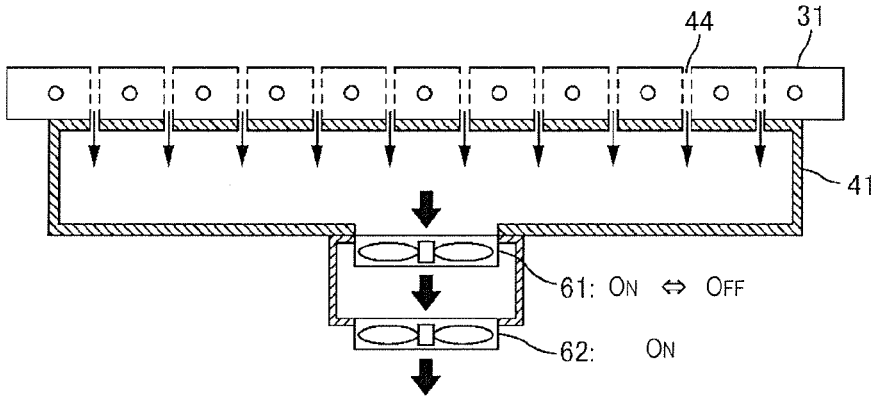
FIGS. 4A and 4B are drawings describing the suction units of comparative examples.
Figure 4B:
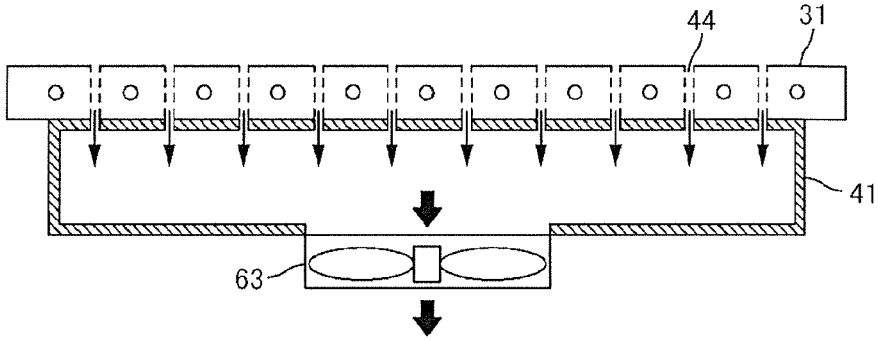

FIGS. 4A and 4B are drawings for describing suction units of comparative examples.

The negative pressure in the negative pressure chamber 41 can be set to the desired negative pressure during both suction modes also by attaching two fans 61, 62 in series as shown in FIG. 4A, turning the two fans 61, 62 on during the high suction mode, and turning one fan 61 of the two fans 61, 62 off during the low suction mode.

The negative pressure in the negative pressure chamber 41 can be set to the desired negative pressure during both suction modes also by attaching one fan 63 having high maximum static pressure characteristics and controlling the rotating speed as shown in FIG. 4B.

However, in cases such as the comparative examples (FIGS. 4A and 4B) in which fans are attached to the same position (one location) on the outside surface of the negative pressure chamber 41, one fan mechanism 43 of the two fan mechanisms 42, 43 cannot be used as an air hole as it can in the present embodiment (FIG. 3B). Therefore, the suction units of the comparative examples require to switch from the high suction mode to the low suction mode than with the suction unit 40 of the present embodiment.

Consequently, in the present embodiment, the two fan mechanisms 42, 43 are attached at different positions on the outside surface of the negative pressure chamber 41. To be more specific, the two fan mechanisms 42, 43 are attached at different positions on the outside surface of the negative pressure chamber 41 in another location (the bottom surface 41*a* and the side surface 41*b*) from the top surface 41*c* provided with holes communicated with the suction holes 44. In the present embodiment, an example is given in which the two fan mechanisms 42, 43 are attached to the bottom surface 41*a* of the negative pressure chamber 41, but the present invention is not limited to this example and the two fan mechanisms 42, 43 may also be attached to the side surface 41*b* of the negative pressure chamber 41.

At least two fan mechanisms are preferably attached to the negative pressure chamber 41, and even when three or more fan mechanisms are attached, (at least) one fan mechanism can be stopped during the low suction mode and the stopped fan mechanism can thereby be used as an air hole. As a result, the period for switching from the high suction mode to the low suction mode can be shortened. There may also be a parallel attachment of two fan mechanisms (i.e. second fan mechanisms 43) in both of which are attached two fans in series. In this case, the two fan mechanisms may be turned on (i.e. the four fans are turned on) during the high suction mode, and during the low suction mode, one fan mechanism may be stopped while only one of the two fans belonging to the other fan mechanism is turned on (i.e., three fans may be turned off).

During the previously described maintenance action (during the discharge problem inspection or the cleaning action), there is no need to strengthen the suction-holding force of the roll paper R on the support surface of the platen 31 as in the printing action. In view of this, the low suction mode is preferably set during the maintenance action. Loud noise or vibration can thereby be reduced, and power consumption can be minimized.

Particularly, in the printer 1 of the present embodiment, the two fan mechanisms 42, 43 are attached intermittently to the platen 31 via the negative pressure chamber 41 as shown in FIG. 2. Therefore, vibration from the two fan mechanisms 42, 43 is readily transferred via the base stand 1*b* of the printer 1 where the negative pressure chamber 41 and platen 31 are placed, to the discharge problem inspection unit (not shown) placed on the base stand 1*b* in the home position. When a problem with discharge is determined based on electrical changes occurring in the detection electrodes, as is the case with the discharge problem inspection previously described, the vibration of the fan mechanisms 42, 43 is a source of noise. Consequently, vibration can be reduced during the maintenance action by setting to the low suction mode and stopping one fan mechanism 43 of the two fan mechanisms 42, 43. As a result, the noise during the discharge problem inspection can be reduced and the precision of discharge problem inspection can be increased.

Another option is a structure in which the two fan mechanisms 42, 43 are directly attached to the platen 31. A shock-absorbing material may be provided between the negative pressure chamber 41 and the fan mechanisms 42, 43 in order to reduce the vibration of the fan mechanisms 42, 43. In the printer 1 of the present embodiment, the platen 31 and the negative pressure chamber 41 are separate members, but the present invention is not limited to this example and the top surface 41*c* of the negative pressure chamber 41 may be used as the platen 31.

Printing Action

Figure 5A:
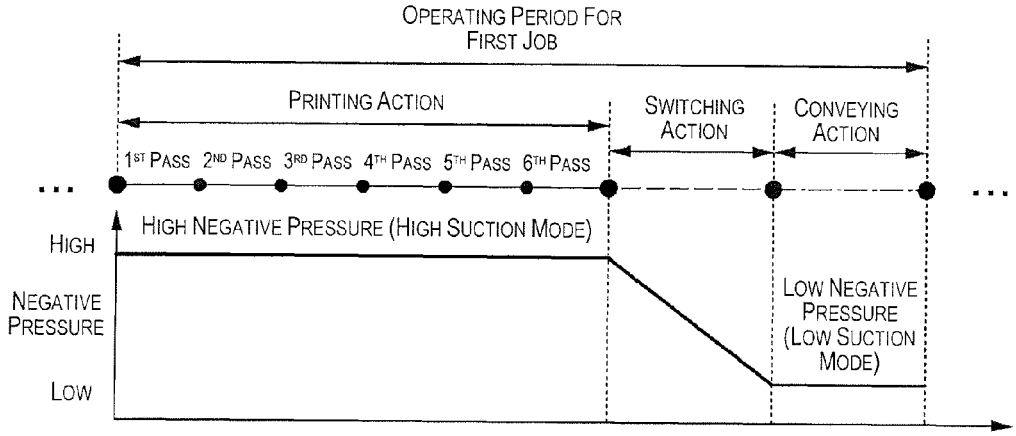
FIG. 5A is a drawing describing the operating period for a first job in a comparative example.
Figure 5B:
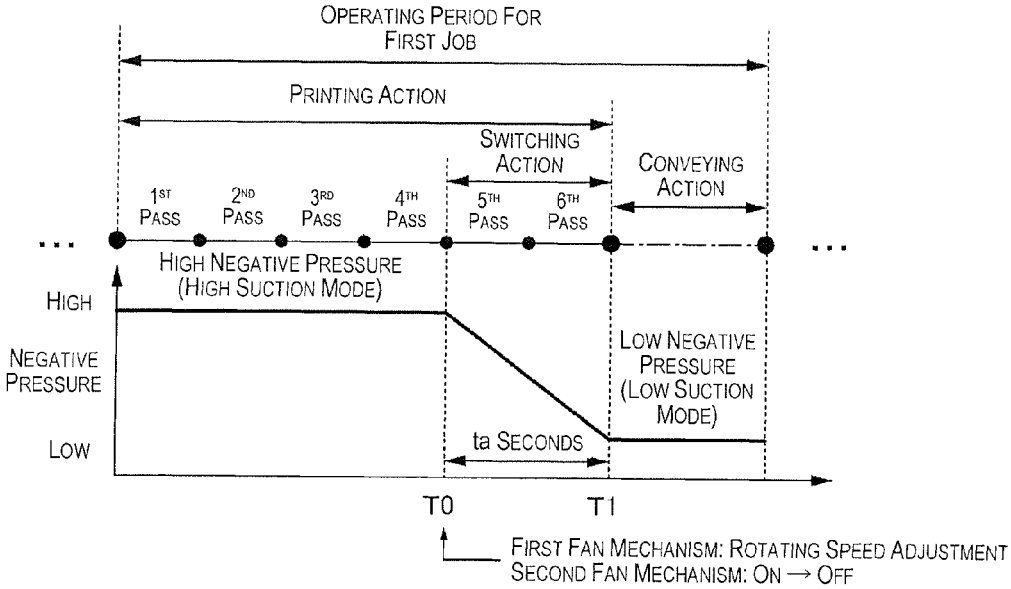
FIG. 5B is a drawing describing the operating period for a first job in the present embodiment.

FIG. 5A is a graph for describing the operating period for a first job in a comparative example, and FIG. 5B is a graph for describing the operating period for a first job in the present embodiment. The first job takes place from the printing action, in which an image is printed on the roll paper R positioned in the print area, until the conveying action, in which a new region of the roll paper R is conveyed to the print area. The action in which the head 33 discharges ink onto the roll paper R positioned in the print area while moving in the X direction (the conveying direction of the roll paper) relative to the roll paper R is referred to as the "first pass." A two-dimensional image is printed on the roll paper R by the action of the head 33 moving in the Y direction (the width direction of the roll paper R) between passes. Hereinbelow, an example is described in which printing of an image on the roll paper R positioned in the print area is completed in six passes. The number of passes in which image printing is completed varies depending on the size of the image and the print resolution.

In a comparative example (FIG. 5A), the controller 10 of the printer 1 maintains the high suction mode during the entire printing action (during all six passes), and performs a switching action of switching from the high suction mode to the low suction mode after the printing action. After the switch from the high suction mode to the low suction mode is complete, the controller 10 performs the conveying action. Specifically, the operating period for one job in the comparative example is the combined total of the period required for the printing action, the period required for the switching action, and the period required for the conveying action; and the operating period for one job is comparatively long.

In the printer 1 of the present embodiment, as previously described, one fan mechanism 43 of the two fan mechanisms 42, 43 that create negative pressure in the negative pressure chamber 41 is stopped during the low suction mode, and the stopped fan mechanism 43 is used as an air hole. The period for switching from the high suction mode to the low suction mode is then shortened. However, even through the period for the switching action is shortened, it is inefficient to take time only for the switching action, which is an action other than printing, as in the comparative example (FIG. 5A).

Consequently, in the present embodiment, it is an object to shorten the overall printing operating period as much as possible.

In view of this, in the printer 1 of the present embodiment (FIG. 5B), during the operation prior to the conveying action, i.e. during the printing action, the controller 10 switched from the high suction mode to the low suction mode by stopping one fan mechanism 43 of the two fan mechanisms 42, 43.

According to this type of printer 1 (or according to the print method that uses this type of printer 1), since the switching action is performed in parallel with the printing action, there is no period taken for the switching action alone, and the overall printing operating period can be shortened in comparison with the comparative examples. Specifically, the operating period for one job in the present embodiment is the combined total of the period required for the printing action and the period required for the conveying action, and this operating period can be shortened by an amount equivalent to the period required by the switching action in comparison with the operating period for one job in the comparative examples.

In the printer 1 of the present embodiment, in order to shorten the period for switching from the high suction mode to the low suction mode, the two fan mechanisms 42, 43 are attached in parallel at different positions in the negative pressure chamber 41 as shown in FIG. 3. During the low suction mode, one fan mechanism 43 of the two fan mechanisms 42, 43 is stopped and this stopped fan mechanism 43 (more specifically, the opening 41*e* of the negative pressure chamber 41 that is communicated with the suction port of the fan mechanism 43) is used as an air hole, but the present invention is not limited to this configuration. For example, if the printer has the suction unit shown in FIG. 4A, which is the comparative example previously described, the device can be reduced in size and cost, and the desired suction force can be achieved (the desired negative pressure can be achieved in the negative pressure chamber 41) in both suction modes. Consequently, the printer may have the suction unit shown in FIG. 4A, in which case the two fans 61, 62 of FIG. 4A are equivalent to the "two air-blowing parts," the fan 61 that stops during the low suction mode is equivalent to the "one air-blowing part," and the fan 62 that does not stop during the low suction mode is equivalent to the "other air-blowing part."

The interior of the negative pressure chamber 41 can also be set to the desired negative pressure by controlling the rotating speed of the fan mechanism 42 instead of controlling the turning on and off of the fan mechanisms 42, 43, and as a result, the suction force on the roll paper R can be brought to the desired suction force. For example, in the present embodiment, during the high suction mode, the interior of the negative pressure chamber 41 is brought to the desired high negative pressure (the desired high suction force) by operating both of the two fan mechanisms 42, 43 at 100% rotating speed, and during the low suction mode, the interior of the negative pressure chamber 41 is brought to the desired low negative pressure (the desired low suction force) by stopping the second fan mechanism 43 (0% rotating speed) and operating the first fan mechanism 42 at 65% rotating speed.

Consequently, when the controller 10 switches from the high suction mode to the low suction mode (at the start of the switching action, T0 in FIG. 5B), the controller 10 stops the second fan mechanism 43 (equivalent to the one air-blowing part) and sets the rotating speed of the first fan mechanism 42 (equivalent to the other air-blowing part) to a rotating speed corresponding to the suction force in the low suction mode (65% rotating speed in this case). The pressure in the negative pressure chamber 41 can thereby be stably transitioned from a high negative pressure to a low negative pressure (the mode is stably transitioned from high suction to low suction) with simple control.

In the present embodiment, the controller 10 initiates the switching action from the high suction mode to the low suction mode in the latter half of the printing action. For example, when printing of an image is completed in six passes, the controller 10 switches from the high suction mode to the low suction mode after the fourth pass, as shown in FIG. 5B. The switch from the high suction mode to the low suction mode may be performed between passes or during a pass. As a result, the period for the high suction mode can be lengthened during the printing action. The roll paper R on the platen 31 can thereby be kept flat over a long period of time during the printing action, and loss in quality of the printed image can be suppressed (ink blurring, contact with the head 33, and the like can be prevented).

Furthermore, in the present embodiment, the controller 10 initiates the switching action from the high suction mode to the low suction mode at a point in time (T0) which is calculated back from the ending point in time of the printing action (T1 in FIG. 5B) by the period (ta seconds) required for the switching action. In FIG. 5B, since the period (ta seconds) required for the switching action is equivalent to the printing period for two passes, the switching action is initiated at the start of the fifth pass. An example is given here of the image printing being completed with the sixth pass, but the switching action may also be initiated at the start of the third pass when image printing is completed with the fourth pass, for example, or the switching action may be initiated at the start of the fifteenth pass when image printing is completed with the sixteenth pass. As a result, the period for the high suction mode during the printing action can be lengthened. The roll paper R on the platen 31 can thereby be kept flat in a predetermined position over a longer period of time during the printing action, and loss in quality of the printed image can be suppressed.

The period (ta seconds) required for the switching action from the high suction mode to the low suction mode may be determined when the printer 1 is being designed (with each model of the printer 1) or when the printer 1 is being manufactured (with each printer 1 unit). There are also cases of errors in the period required for the switching action. In view of this, to provide more leeway, the switching action may be initiated at a point in time determined by calculating the combined total ($ta+\alpha$) of the switching action period (ta seconds) and the error period ($\alpha$) back from the ending time point of the printing action (T1 of FIG. 5B). The conveying action can thereby be performed after having reliably switched from the high suction mode to the low suction mode.

There are also cases in which the maintenance action (the discharge problem inspection or the conveying action) is periodically performed after the printing action. By setting to the low suction mode during the maintenance action as previously described, vibration and loud noises can be reduced, and the precision of the discharge problem inspection can be increased. Therefore, it is possible to perform the maintenance action immediately after the printing action ends, due to switching from the high suction mode to the low suction mode during the printing action as in the present embodiment. Consequently, the overall printing operating period can be shortened.

Modifications

Figure 6A:
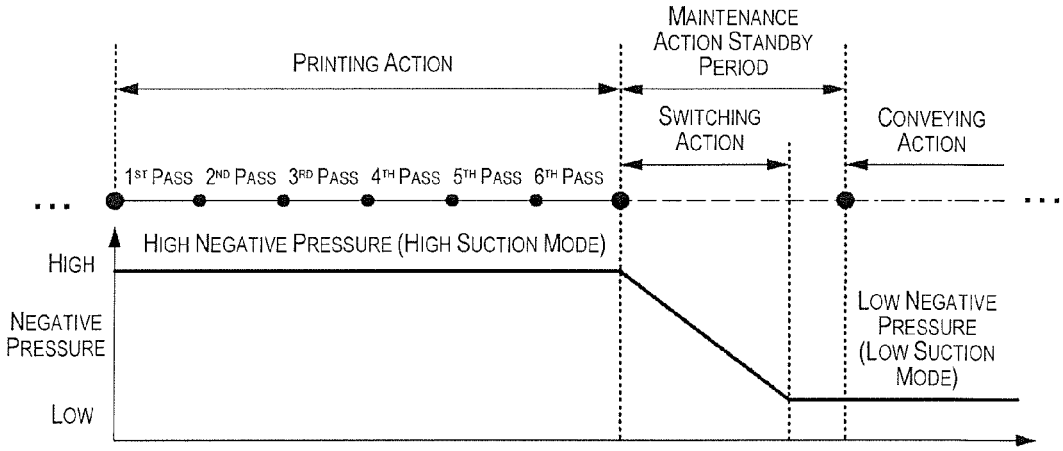
FIGS. 6A and 6B are graphs describing modifications of the printing action.
Figure 6B:
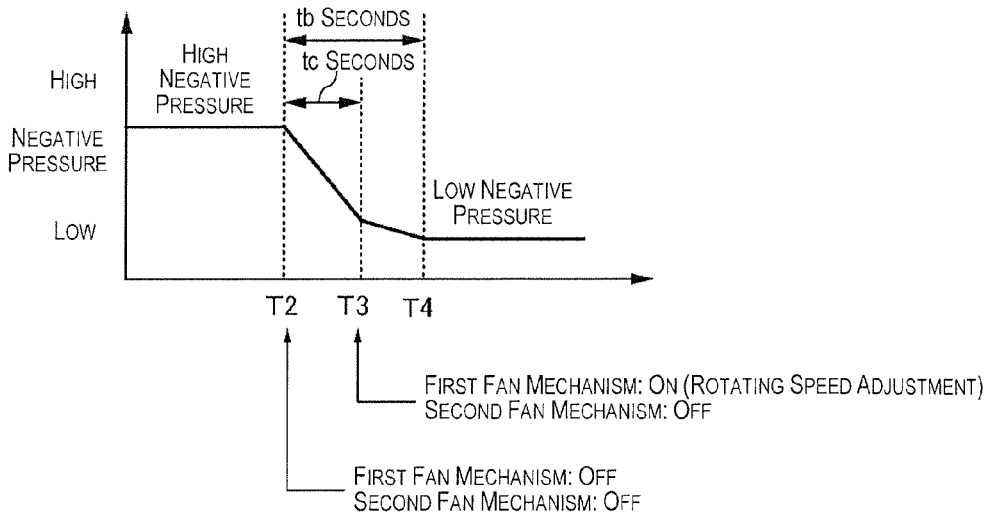

FIGS. 6A and 6B are graphs describing modifications of the printing action. In the embodiment previously described (FIG. 5B), an example was presented in which the conveying action was performed immediately after the printing action, but the present invention is not limited to this example. There are also cases in which the maintenance action is performed periodically after the printing action and the conveying action is then performed after the maintenance action. There is also a printer 1 in which a "standby period" can be set, which is a period in which no action is performed following multiple printing actions or following the overall printing action. With such a printer 1, the standby period follows the printing action and the conveying action is performed after the standby period has elapsed.

In view of this, in a modification, the controller 10 is designed so as to switch from the high suction mode to the low suction mode "during the maintenance action" or "during the standby period" which are actions preceding the conveying action, as shown in FIG. 6A, rather than switching from the high suction mode to the low suction mode during the printing action. The high suction mode is thereby in effect throughout the entire printing action, the roll paper R on the platen 31 can be kept flat in a predetermined position, and quality loss in the printed image can be suppressed. The overall printing operating period can be shortened in comparison with cases in which the switching action is performed after the printing action and the maintenance action or the standby period is performed thereafter. Specifically, the switching action is performed in parallel with another action (the maintenance action or the standby period), which is efficient. In FIG. 6A, the switching action is performed simultaneously with the starting of the maintenance action or the standby period, but the present invention is not limited to this sequence, and the switching action may also be performed during the latter half of the maintenance action or the standby period, for example.

In the embodiment previously described (FIG. 58), when a switch is made from the high suction mode to the low suction mode (at the start of the switching action), the second fan mechanism 43 is stopped and the rotating speed of the first fan mechanism 42 is set to a rotating speed corresponding to the suction force in the low suction mode (65% rotating speed), but the present invention is not limited to this example.

The controller 10 may also stop the two fan mechanisms 42, 43 (turn them off) when a switch is made from the high suction mode to the low suction mode (at the start of the switching action, T2 in FIG. 6B), and then set the rotating speed of the first fan mechanism 42 (equivalent to the other air-blowing part) to a rotating speed corresponding to the suction force during the low suction mode (65% rotating speed) after a predetermined period (tc seconds) has elapsed (at the time point T3), as shown in FIG. 6B, for example.

The two fan mechanisms 42, 43 can thereby be opened to the atmosphere and the negative pressure in the negative pressure chamber 41 can be quickly lowered (the pressure can be raised) after switching to the low suction mode (T2 to T3), and the period for switching from the high suction mode to the low suction mode can be shortened. Specifically, the two fan mechanisms 42, 43 (more precisely, the openings 41*d*, 41*e* of the negative pressure chamber 41 communicated with the respective suction ports of the two fan mechanisms 42, 43) are used as air holes immediately after switching to the low suction mode. By operating the first fan mechanism 42 at a rotating speed of 65% after a predetermined period has elapsed (T3), the negative pressure in the negative pressure chamber 41 can be brought to a low negative pressure corresponding to the low suction mode.

The period (tb seconds in FIG. 6B) required by the switching action in this modification can be shorter than the period (ta seconds in FIG. 5B) required by the switching action in the embodiment previously described. Consequently, the period for the high suction mode can be even longer during actions preceding the conveying action. If the action preceding the conveying action is the printing action, the roll paper R can be kept flat in a predetermined position for a longer period of time, and quality loss in the printed image can be suppressed. However, control is easier in the embodiment previously described (FIG. 5B), and transitioning from the high suction mode to the low suction mode is more stable.

Other Embodiments

The present embodiment primarily describes an image recording device, but also includes the disclosure of an image recording method, for example. The present embodiment is intended to make the present invention easier to understand, and should not be interpreted as limiting the present invention. The present invention can of course be modified and improved without deviating from the scope thereof, and such equivalents are also included in the present invention. The embodiments described hereinbelow in particular are also included in the present invention.

Printer

In the embodiment previously described, an example of a printer 1 was given in which an image was printed on roll paper R positioned in a print area while the head 33 was moved in the conveying direction and width direction of the roll paper R, but the present invention is not limited to this example. The printer may also print images when the roll paper R passes underneath a stationary head 33, for example.

The medium on which the image is recorded is not limited to roll paper R and may be single sheets of paper, and the image recording device may record images on the medium by discharging a fluid other than ink from the nozzles.

The image recording device is also not limited to a printer, and the above-described present embodiment and similar technologies may also be applied to various other devices that use the inkjet technology, such as color filter manufacturing devices, dye devices, micromachining devices, semiconductor manufacturing devices, surface machining devices, three-dimensional modeling devices, gasifying and vaporizing devices, organic EL manufacturing devices (particularly macromolecular EL manufacturing devices), display manufacturing devices, film-forming devices, and DNA chip manufacturing devices. These methods and manufacturing methods are also categorized in the applicable range.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image recording device comprising:

a recording part configured and arranged to record an image on a medium;

a conveying part configured and arranged to convey the medium;

a medium support part configured and arranged to support the medium on a support surface provided with openings of suction holes;

a suction part configured and arranged to suction the medium supported on the medium support part via the suction holes, the suction part including first, second, third air-blowing parts being configured to suck the medium; and a control part configured to repeatedly perform an action of conveying the medium using the conveying part and an action of recording the image on the medium using the recording part, the second air-blowing part being configured to introduce thereinto air that flows through the suction holes and discharge the air in an introducing and discharging direction, the second and third air-blowing parts being aligned in the introducing and discharging direction, the control part being configured to stop either the first air-blowing part or a combination of the second and third air-blowing parts during an action preceding the conveying action, the control part being configured to switch between first and second modes of suction, the first mode being for a first suction force to be applied by the suction part on the medium, the second mode being for a second suction force that is lower than the first suction force to be applied by the suction part on the medium.

2. The image recording device according to claim 1, wherein the action preceding the conveying action is the recording action.

3. The image recording device according to claim 2, wherein the control part is configured to switch from the first mode to the second mode during the latter half of the recording action.

4. The image recording device according to claim 1, wherein the control part is configured to stop the one of the air-blowing parts and to set a rotating speed of the other one of the air-blowing parts to a rotating speed corresponding to the second suction force when switching from the first mode to the second mode.

5. The image recording device according to claim 1, wherein the control part is configured to stop the air-blowing parts when switching from the first mode to the second mode, and to set the rotating speed of the other one of the air-blowing parts to a rotating speed corresponding to the second suction force after a predetermined period has elapsed.

6. The image recording device according to claim 1, wherein the one of the air-blowing parts includes at least two air-blowing mechanisms aligned in series.

7. An image recording method for recording an image on a medium by an image recording device including:

a recording part configured and arranged to record an image on a medium;

a conveying part configured and arranged to convey the medium;

a medium support part configured and arranged to support the medium on a support surface provided with openings of suction holes;

a suction part configured and arranged to suction the medium supported on the medium support part via the suction holes, the suction part including first, second, third air-blowing parts being configured to suck the medium, the second air-blowing part being configured to introduce thereinto air that flows through the suction holes and discharge the air in an introducing and discharging direction, the second and third air-blowing parts being aligned in the introducing and discharging direction; and a control part configured to repeatedly perform an action of conveying the medium using the conveying part and an action of recording the image on the medium using the recording part, the image recording method comprising:

stopping either the first air-blowing part or a combination of the second and the third air-blowing parts during and action preceding the conveying action; and switching between first and second modes of suction, the first mode being for a first suction force to be applied by the suction part on the medium, the second mode being for a second suction force that is lower than the first suction force to be applied by the suction part on the medium.

8. An image recording device comprising:

a recording part configured and arranged to record an image on a medium;

a conveying part configured and arranged to convey the medium;

a medium support part configured and arranged to support the medium on a support surface provided with openings of suction holes;

a suction part configured and arranged to suction the medium supported on the medium support part via the suction holes, the suction part including first and second air-blowing parts being configured to suck the medium; and a control part configured to repeatedly perform an action of conveying the medium using the conveying part and an action of recording the image on the medium using the recording part, the first air-blowing part being configured to introduce thereinto air that flows through the suction holes and discharge the air in an introducing and discharging direction, the first and second air-blowing parts being aligned in the introducing and discharging direction, the control part being configured to stop both the first and the second air-blowing parts during an action preceding the conveying action, the control part being configured to switch between first and second modes of suction, the first mode being for a first suction force to be applied by the suction part on the medium, the second mode being for a second suction force that is lower than the first suction force to be applied by the suction part on the medium.

* * * * *